US007816615B2

(12) United States Patent
Yanai et al.

(10) Patent No.: US 7,816,615 B2
(45) Date of Patent: Oct. 19, 2010

(54) PUSH-SWITCH

(75) Inventors: Yasunori Yanai, Okayama (JP); Yoshikazu Yagi, Okayama (JP)

(73) Assignee: Panasonic Corporation, Osaka (JP)

( * ) Notice: Subject to any disclaimer, the term of this patent is extended or adjusted under 35 U.S.C. 154(b) by 165 days.

(21) Appl. No.: 12/054,509

(22) Filed: Mar. 25, 2008

(65) Prior Publication Data

US 2008/0257705 A1 Oct. 23, 2008

(30) Foreign Application Priority Data

Apr. 17, 2007 (JP) ..... 2007-107939

(51) Int. Cl.
*H01H 13/14* (2006.01)

(52) U.S. Cl. ..... 200/521; 200/406

(58) Field of Classification Search ..... 200/1 B, 200/5 A, 5 B, 406, 275, 292, 512–517, 521
See application file for complete search history.

(56) References Cited

U.S. PATENT DOCUMENTS 4,412,113 A * 10/1983 Mitsugi et al. ..... 200/406
5,898,147 A * 4/1999 Domzalski et al. ..... 200/1 B
7,485,824 B2 * 2/2009 Rastemborski et al. ..... 200/516
2001/0052452 A1 * 12/2001 Yokobori ..... 200/406

FOREIGN PATENT DOCUMENTS

CN 2228261 Y 5/1996
CN 200810091994.7 4/2010
JP 2000-294079 A 10/2000
JP 2005-32705 A 2/2005

* cited by examiner

*Primary Examiner*—Renee Luebke
*Assistant Examiner*—Lisa Klaus
(74) *Attorney, Agent, or Firm*—RatnerPrestia

(57) ABSTRACT

A push switch includes a movable contact, and a drive body. The movable contact includes an annular part with a circular central hole and four leg parts inclined and extruded downward from the outer circumferential end of the annular part by way of a deflection part, formed in a shape bulging upward at the circular central hole side. The drive body includes a flat plate with the lower end abutting against the position of the inner side of the deflection part of the movable contact, and an operation part of a smaller diameter than the abutting position provided on the flat plate, if the operation part is pressed and manipulated at a position remote from the center, a light and responsive click feel is obtained.

2 Claims, 6 Drawing Sheets

PUSH-SWITCH

BACKGROUND OF THE INVENTION

1. Field of the Invention

The present invention relates to a push-switch having a light click feel used in operation parts of various electronic appliances.

2. Background Art

Switches used in operation parts of various electronic appliances are mostly so-called push-switches having a dome-shaped movable contact made of an elastic thin metal plate capable of assuring a light click feel in operation, and a low contact resistance value.

For example, a conventional push-switch disclosed in Unexamined Japanese Patent Publication No. 2000-294079 is described below by referring to FIG. 8 to FIG. 10.

FIG. 8 is a sectional view of the conventional push-switch. In the diagram, switch case 1 is made of an insulating resin formed by inserting, by exposing middle fixed contact 2 and two outside fixed contacts 3 at both sides across middle fixed contact 2, in a concave inner bottom of an upper opening. Terminals 4 linking to middle fixed contact 2 and outside fixed contacts 3 are individually extended outward.

Circular dome-shaped movable contact 5 formed of an elastic thin metal plate bulging upward at its middle has its outer circumferential lower end placed on outside fixed contacts 3, and the downside of the dome-shaped peak part is opposite to middle fixed contact 2 across a spacing. Drive body 6 has circular columnar operation part 6B projecting at the upside middle of flat plate part 6A and small circular columnar pressing part 6C projecting at the downside middle, and pressing part 6C at the downside is abutting against the dome-shaped peak part of movable contact 5.

Operation part 6B of drive body 6 projects from middle hole 7A, and cover 7 of metal plate is fitted to cover the concave upside of switch case 1 from the upside of flat plate 6A, and the conventional push-switch is formed.

The operation of the conventional push-switch having such configuration is described below. The following explanation is based on FIG. 9, in which the axis of abscissas denotes the operation stroke, that is, the pressing distance, and the axis of ordinates represents the pressing force.

From an ordinary state (point O) free of pressing force, when a pressing force is applied from above to operation part 6B of drive body 6, the dome-shaped peak part of movable contact 5 is pressed by downside pressing part 6C. When this pressing force exceeds the elastic deformation force (point P) of movable contact 5, the dome-shaped portion projects downward and is inverted elastically along with a click feel, and the downside of the dome-shaped peak part contacts with opposite middle fixed contact 2. As a result, outside fixed contacts 3 and middle fixed contact 2 conduct with each other by way of movable contact 5, so that the switch is turned on.

Then, releasing the pressing force gradually, when the pressing force becomes smaller the self-restoring force (point Q) of movable contact 5, the dome-shaped portion of movable contact 5 projecting downward bulges upward along with a click feel to restore elastically into a dome shape, leaving from middle fixed contact 2, so that the switch is turned off.

The percentage of the relation of elastic deformation force (P) and self-restoring force (Q), (P−Q)/P, is the click rate, and when it is in a range of 35% to 65%, it is favored as a light and responsive click feel.

In the conventional push-switch, a favorable click feel is obtained by pressing the dome-shaped peak part of movable contact 5. Although a favorable click feel is obtained by pressing the upside region of operation part 6B corresponding to the region of forming pressing part 6C at the downside of drive body 6, as the pressing position is deviated from the region of pressing part 6C, the click feel becomes poor.

This phenomenon is explained in FIG. 10. FIG. 10 is a relation diagram in which the axis of abscissas denotes the eccentric amount of the pressing position from the center of the switch (the center of switch case 1), and the axis of ordinates represents the click rate, and point O of the eccentric amount is the pressure at the central position of the switch, and the minus side shows the moving amount of the pressing position to the leftward direction in FIG. 8.

The conventional push-switch measured in FIG. 10 was 1.2 mm in diameter of pressing part 6C of drive body 6, and 3 mm in diameter of operation part 6B. When the eccentric amount of deviating the pressing position to operation part 6B from the center of the switch was in a range of −0.6 mm to 0.4 mm, the click rate was maintained at 35% to 65%, but at the pressing position exceeding the specified range of the eccentric amount, the click rate was low, and the click feel was dull. In this result, the numerical value of the eccentric amount was different between the plus side and the minus side, which is estimated due to deviation of the combination state of switch case 1 with drive body 6 in a horizontal direction.

This dull state of click feel may be estimated as follows. When the pressing position of operation part 6B is at an outer side from the position of pressing part 6C for pressing movable contact 5, the upside end of flat plate 6A at the opposite side of the pressing position becomes the fulcrum, and drive body 6 is inclined, and the pressing position of movable contact 5 is deviated from the dome-shaped peak part. At the same time, as compared with the pressing amount (operation stroke) of drive body 6, the downward deflection amount (moving extent) of the dome-shaped portion of movable contact 5 becomes smaller, and the pressing position downside of movable contact 5 abuts against the inner bottom of switch case 1. Hence, it is estimated that favorable click feel is not obtained.

To solve this problem, it is an idea to change the dimensional relation of operation part 6B and pressing part 6C of drive body 6, but the dimension of the dome-shaped peak part must be increased by increasing the diameter of circular dome-shaped movable contact 5, and the size cannot be reduced. Or when operation part 6B is formed in a smaller diameter than pressing part 6C, an allowable region for pressing to operation part 6B is too narrow, and the deviation of the mounted electronic appliance cannot be absorbed.

SUMMARY OF THE INVENTION

The present invention is intended to solve the problems of the prior art, and it is hence an object thereof to present a small-sized push-switch of a wide operation region, assuring a light and responsive click feel, if the operation part is pressed and manipulated at a position remote from the center of the push-switch.

The push-switch of the present invention includes a box-shaped switch case made of an insulating resin, having an open upside, and a plurality of fixed contacts disposed in the concave inner bottom with a plurality of grooves provided in the inner wall, at symmetrical positions from the center of the concave part, with the fixed contacts being electrically connected with terminals extended outward; a movable contact formed of an elastic thin metal plate in a shape bulging upward, contained in the concave part of the switch case, having an annular part with a central hole disposed oppositely upward to the fixed contacts, and a plurality of leg parts inclined and extruded downward from the outer circumferential end of the annular part by way of a deflection part, and formed corresponding to the plurality of grooves; a drive body having an operation part projecting upward of a flat plate, with the lower end of the flat plate abutting against the deflection part of the movable contact or a position of a smaller diameter than the deflection part, with the abutting position located at a position same as the outside diameter of the operation part in a horizontal direction or at a position at an outer side from the outside diameter of the operation part; and a cover fixed by covering the concave part upside of the switch case by projecting the operation part of the drive body upward from a middle hole of the movable contact.

In this configuration, when the switch is manipulated, the deflection part of the movable contact or the inner side of the deflection part is pressed by the lower end of the drive body, and the outside diameter of the operation part at the manipulated position is designed to be same as the pressing position of the movable contact or at the central side of the switch. Accordingly, regardless of the pressing position to the operation part, the pressing position of the movable contact is unchanged and stable. Therefore, the click feel is hardly changed when inverting elastically by pressing, and a light and responsive click feel is obtained stably, and a push-switch of a wide pressing region and a small size is realized.

In the present invention, the lower end of the flat plate of the drive body abutting against the movable contact is a pressing part formed by projecting like a ring.

Accordingly, the ring-shaped projecting pressing part abuts against the annular part of the movable contact, and the annular part can be pressed uniformly in a wide range. Therefore, when pressing, the movable contact is elastically deformed stably, and the light and responsive click feel is further stabilized.

Also in the present invention, the spacing between the concave inner bottom of the switch case opposite through the central hole of the movable contact and the downside of the drive body has an arresting function after the annular part of the movable contact touches the fixed contact of the switch case by the pressing manipulation on the drive body.

Accordingly, if the drive body is overloaded, the concave inner bottom of the switch case and the drive body are arrested, and deformation of the movable contact is prevented, and the pressing strength is improved.

BRIEF DESCRIPTION OF THE INVENTION

DETAILED DESCRIPTION OF THE INVENTION

The best modes for carrying out the present invention are described below while referring to the accompanying drawings.

An exemplary embodiment of the present invention is explained while referring to FIG. 1 to FIG. 7.

Figure 1:
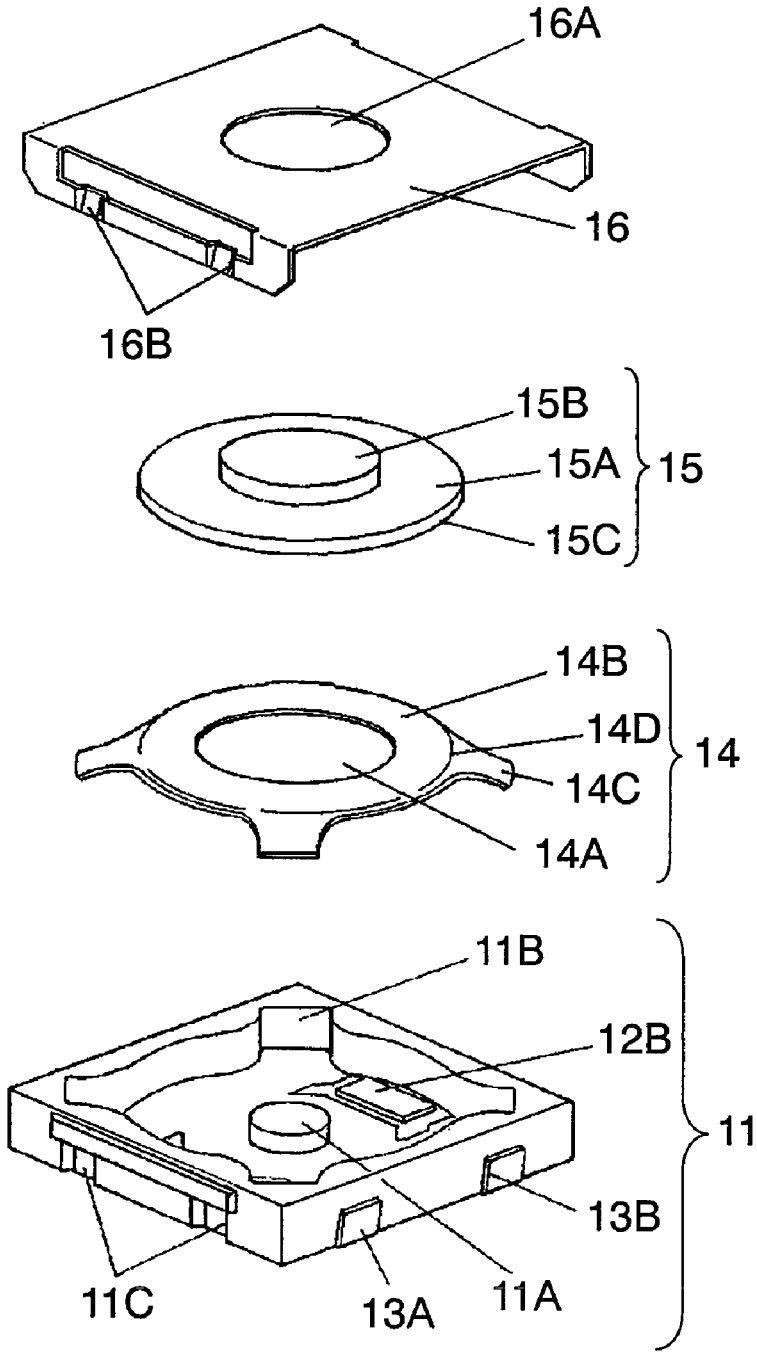
FIG. 1 is a perspective exploded view of a push-switch in an exemplary embodiment of the present invention.
Figure 2:
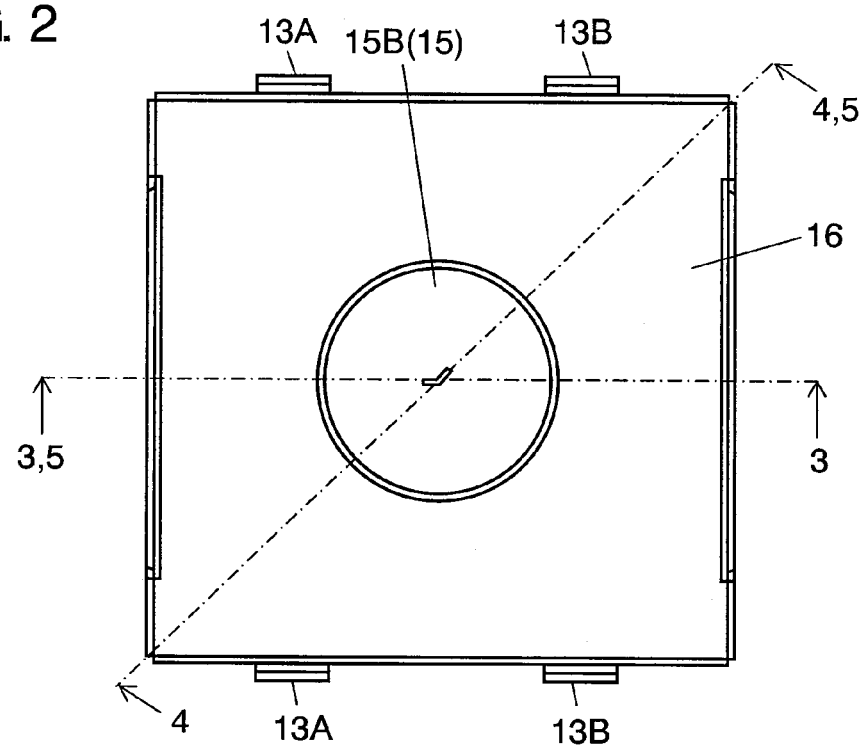
FIG. 2 is its plan view.
Figure 3:
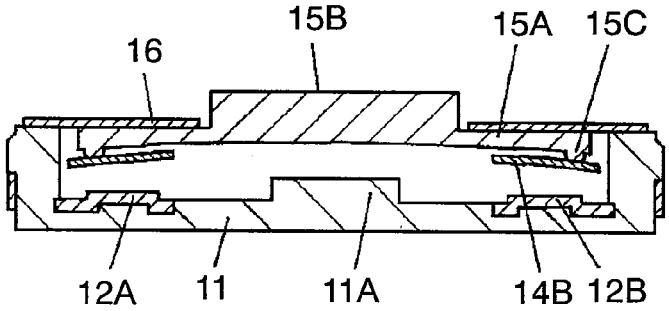
FIG. 3 is a sectional view along line 3-3 in FIG. 2.
Figure 4:
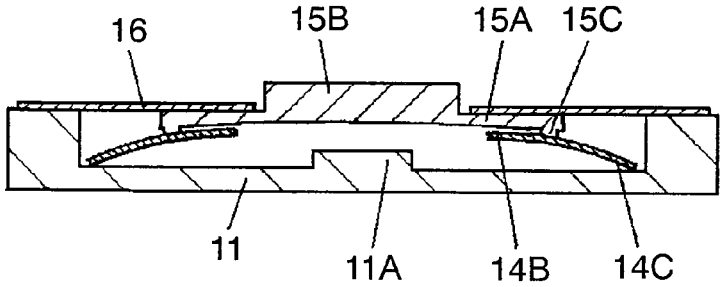
FIG. 4 is a sectional view along line 4-4 in FIG. 2.
Figure 5:
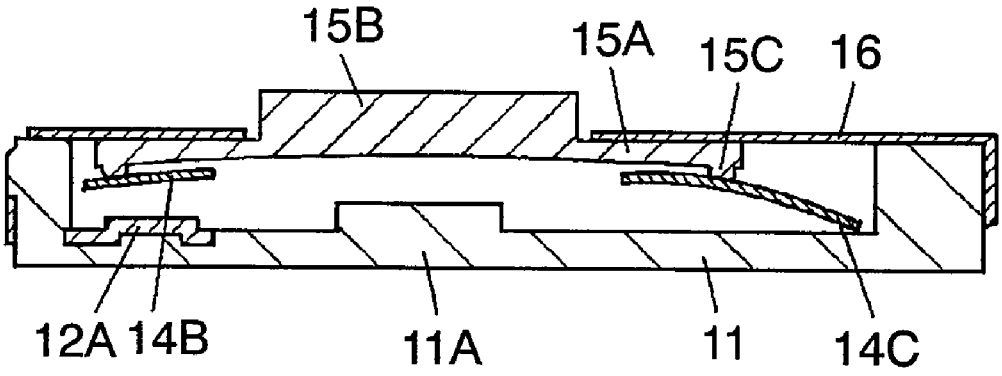
FIG. 5 is a sectional view along line 5-5 in FIG. 2.
Figure 6:
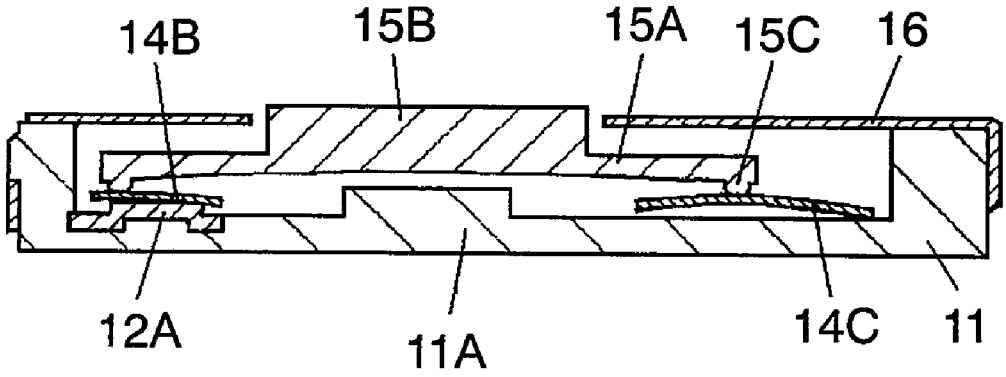
FIG. 6 is a sectional view of operation explanation in FIG. 5.

FIG. 1 is a perspective exploded view of a push-switch in an exemplary embodiment of the present invention, and FIG. 2 is its plan view. FIG. 3 is a sectional view along line 3-3 in FIG. 2, FIG. 4 is a sectional view along line 4-4 in FIG. 2, and FIG. 5 is a sectional view along line 5-5 in FIG. 2. FIG. 6 is a sectional view of operation explanation in FIG. 5.

In FIG. 1 to FIG. 4, box-shape switch case 11 made of an insulating resin has circular columnar part 11A opened at the upside and projecting upward at the center of the circular concave inner bottom, and fixed contacts 12A, 12B disposed at peripheral positions of the concave part opposite by 180 degrees at equal distance from circular columnar part 11A. Grooves 11B are disposed at inner walls of the concave part corresponding to four corners of the box shape of switch case 11. Terminals 13A, 13B linked to fixed contacts 12A, 12B are extended outward from a pair of mutually opposite side walls.

Movable contact 14 formed of an elastic thin metal plate has circular central hole 14A of a larger diameter than circular columnar part 11A of switch case 11, and annular part 14B positioned in opposite state above fixed contacts 12A, 12B. Further, movable contact 14 has four leg parts 14C of specified width inclined downward obliquely from the outer peripheral end of annular part 14B by way of deflection part 14D, and extended to be positioned at grooves 11B of switch case 11. Deflection part 14D between the peripheral edge of annular part 14B and leg parts 14C is formed in an arc shape in top view, and movable contact 14 is formed on the whole in a shape bulging upward at the side of circular central hole 14A.

This movable contact 14 is contained and disposed in the concave part with its leg parts 14C positioned in grooves 11B of switch case 11, and in this state, the downside of annular part 14B is opposite to fixed contacts 12A, 12B across a specified spacing.

Drive body 15 formed of an insulating resin is placed on annular part 14B of movable contact 14. Drive body 15 has circular flat plate 15A, circular operation part 15B formed by projecting upward from the upside center of flat plate 15A, and ring-shaped pressing part 15C projecting downward from the downside peripheral edge. Circular operation part 15B is formed in a smaller diameter than ring-shaped pressing part 15C, and the lower end of ring-shaped pressing part 15C is disposed to abut against a position slightly at the inner side from deflection part 14D of annular part 14B of movable contact 14.

Cover 16 of a thin metal plate covers the upside of the concave part of switch case 11 by projecting operation part 15B of drive body 15 from central middle hole 16A. Cover 16 has stopping parts 16B at both ends formed and folded downward. When stopping parts 16B are engaged with stopping concave parts 11C provided at side walls orthogonal to the side walls extended from terminals 13A, 13B of switch case 11, they are connected to switch case 11.

The push-switch in the exemplary embodiment has such configuration. The operation of the exemplary embodiment is explained below. FIG. 5 shows a state before applying a pressing force to operation part 15B of drive body 15.

First, from the state in FIG. 5, when a pressing force is applied to the upside of operation part 15B of drive body 15, the lower end of ring-shaped pressing part 15C provide at the downside of the peripheral edge of flat plate 15A of drive body 15 presses annular part 14B of movable contact 14. When the pressing force exceeds the elastic deformation force of movable contact 14, the portion of annular part 14B bulging upward at the inside from deflection part 14D is elastically inverted to a shape bulging downward along with a click feel.

Consequently, as shown in FIG. 6, the inclination of four leg parts 14C is deflected in a smaller direction, and the downside of annular part 14B touches two opposite fixed contacts 12A, 12B. As a result, conduction is formed between two fixed contacts 12A, 12B byway of movable contact 14, so that the switch is turned on.

From the state shown in FIG. 6, the pressing force applied to operation part 15B of drive body 15 is gradually released until the pressing force is smaller than the self-restoring force of movable contact 14, and movable contact 14 is restored elastically with a click feel, thereby returning to the original state shown in FIG. 5. By this operation, the downside of annular part 14B of movable contact 14 is departed from two fixed contacts 12A, 12B, so that the switch is turned off.

In the switch ON state, when the pressing force is further applied to operation part 15B, the downside of flat plate 15A of opposite drive body 15 abuts against the upside of circular columnar part 11A provided in the middle of the concave inner bottom of switch case 11, by way of circular central hole 14A of movable contact 14. The operation stroke from this switch ON state until drive body 15 abuts against circular columnar part 11A of switch case 11 is set to be slightly longer than the operation stroke for maintaining the switch ON state. By this configuration, if an excessive load is applied to drive body 15, after manipulation of the switch, it is arrested, and the pressing strength is improved without causing deformation of movable contact 14 or the like.

Figure 7:
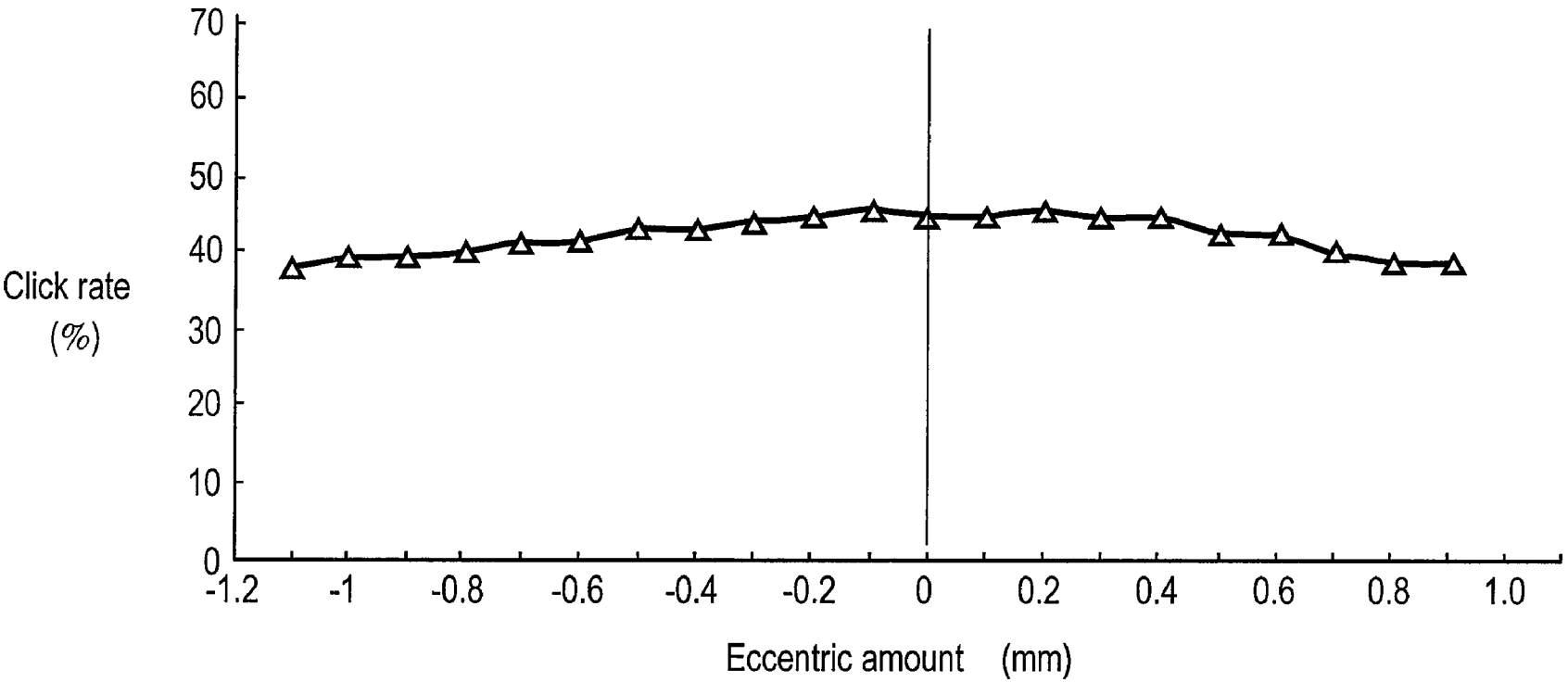
FIG. 7 is a relation diagram of pressing position and click rate of the same.
Figure 8:
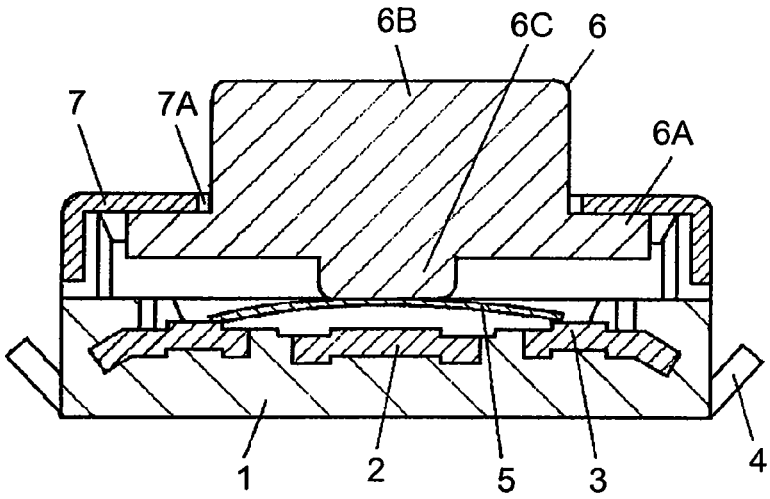
FIG. 8 PRIOR ART
FIG. 8 is a sectional view of a conventional push-switch.
Figure 9:
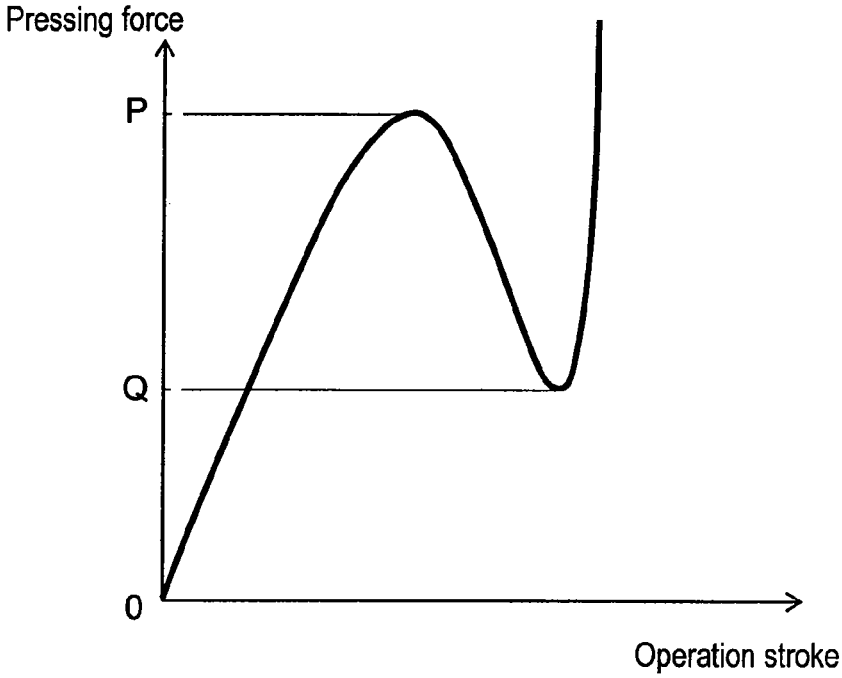
FIG. 9 PRIOR ART
FIG. 9 is a diagram for explaining the click feel in operation of the same.
Figure 10:
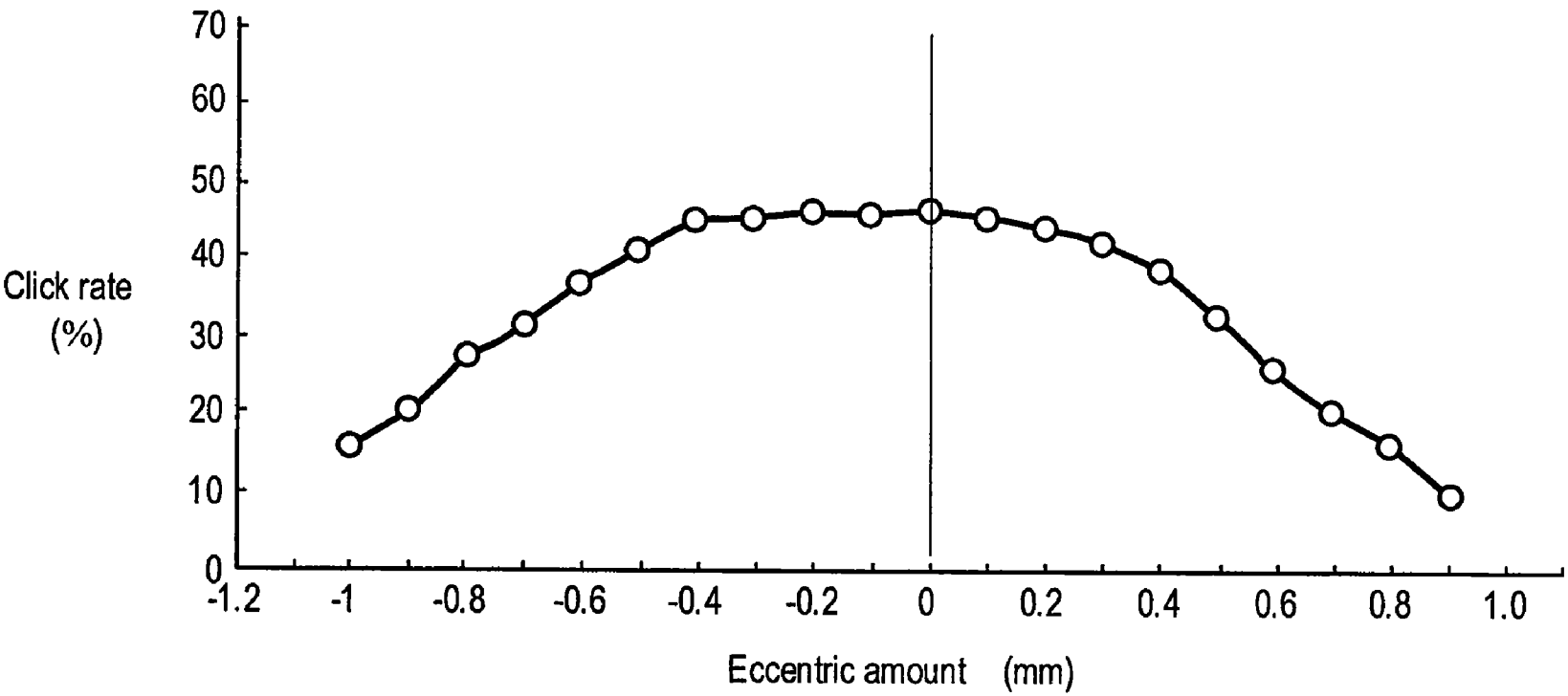
FIG. 10 PRIOR ART
FIG. 10 is a relation diagram of pressing position and click rate of the same.

The relation between the position of pressing drive body 15 and the click rate was investigated. The push-switch of the exemplary embodiment used in this measurement was 2 mm in the diameter of circular columnar operation part 15B of drive body 15, and 2.6 mm in the diameter of ring-shaped pressing part 15C at the downside of the peripheral edge of flat plate 15A. The diameter of deflection part 14D between annular part 14B of movable contact 14 and leg part 14C was 2.8 mm. Results are shown in FIG. 7. In FIG. 7, the axis of ordinates represents the click rate and the axis of abscissas denotes the eccentric amount from the switch center at the pressing position. As clear from the diagram, according to the exemplary embodiment, in a range capable of assuring the click rate of 35% to 65%, the eccentric amount of the pressing position ranged from −1.1 mm to 0.9 mm. In this diagram, same as in the prior art, point O of eccentric amount shows the pressing force at the central position of the switch, and the minus side indicates the leftward moving amount of pressing position in FIG. 3.

In the results, the numerical value of eccentric amount differed between the plus side and the minus side, which was because of combination deviation of drive body 15 and switch case 11 same as in the prior art, and in the switch of the exemplary embodiment used in the measurement, as mentioned above, the diameter of operation part 15B was 2 mm, smaller than the diameter of ring-shaped pressing part 15C at the downside for pressing movable contact 14. Therefore, the results of measurement of −1.1 mm to 0.9 mm evidently show that the click rate was held within 35% to 65% in all region of the range of measuring limits.

Thus, according to the exemplary embodiment, the outline position of operation part 15B is set to be at the central side of the switch, than the position of pressing part 15C of drive body 15 for pressing movable contact 14.

Therefore, if the pressing position to operation part 15B of drive body 15 is changed, the position of pressing down movable contact 14 is unchanged and stable, and a light and responsive click feel is obtained at any part in all surface of the upside of operation part 15B.

Besides, since pressing part 15C at the downside of flat plate 15A of drive body 15 is provided in a ring shape, this ring-shaped pressing part 15C is abutting against annular part 14B of movable contact 14.

Therefore, if the pressing position to operation part 15B is changed, annular part 14B of movable contact 14 can be always pressed stably in a wide range. Hence, movable contact 14 is stably deformed elastically, and a light and responsive click feel is obtained.

In the above explanation, in order to arrest when an excessive load is applied to drive element 15, columnar part 11A is projecting at the central position of the concave inner bottom of switch case 11, and deformation of movable contact 14 is prevented.

To the contrary, by eliminating circular columnar part 11A at the central position of the concave inner bottom of switch case 11, a protrusion may be provided at the downside central position of flat plate 15A of drive body 15 as arresting means.

Further, protrusions may be provided at both sides of switch case 11 side and drive body 15 side as arresting means.

In the above explanation, the outside diameter of operation part 15B of drive body 15 is smaller than the diameter of pressing part 15C, and the pressing position at pressing part 15C is at the inner side of deflection part 14D of movable contact 14.

However, when using movable contact 14, deflection part 14D may be pressed by pressing part 15C, or the outside diameter of operation part 15B may be same as the diameter of pressing part 15C, and the same effects are expected.

What is claimed is:

1. A push-switch comprising:

a switch case having a concave part;

a plurality of fixed contacts disposed in the concave part of the switch case;

a movable contact contained in the concave part of the switch case, the movable contact having an annular part and a plurality of leg parts extending from an outer circumferential portion of the annular part, the movable contact further having a deflection part between the annular part and the plurality of leg parts; and a drive body having a flat part, an operation part projecting upward from the flat part, and an annular part projecting downward from the flat part, the annular part of the drive body abutting against the deflection part of the movable contact or the annular part of the movable contact, wherein a space between the concave part of the switch case and the bottom of the drive body has an arresting function after the annular part of the movable contact touches the fixed contacts of the switch case by pressing the drive body.

2. The push-switch of claim 1, further comprising a protruding part protruding upward from an inner bottom surface of the concave part of the switch case, the protruding part facing a bottom surface of the flat part of the drive body through a central hole of the movable contact, wherein the protruding part abuts against the flat part of the drive body after the annular part of the movable contact touches the fixed contacts of the switch case by pressing the drive body.

* * * * *